US006773323B1

(12) United States Patent
Huang

(10) Patent No.: US 6,773,323 B1
(45) Date of Patent: Aug. 10, 2004

(54) TOY ELEMENT SET FOR CONSTRUCTIONAL TOY

(76) Inventor: Te-Li Huang, P.O. Box 36-80, Taichung City (TW)

( * ) Notice: Subject to any disclaimer, the term of this patent is extended or adjusted under 35 U.S.C. 154(b) by 0 days.

(21) Appl. No.: 10/640,222

(22) Filed: Aug. 12, 2003

(51) Int. Cl.[7] ..... A63H 17/00

(52) U.S. Cl. ..... 446/93; 446/95; 446/103; 446/111; 446/124

(58) Field of Search ..... 446/93–95, 102, 446/103, 108, 111, 112–114, 116, 124

(56) References Cited

U.S. PATENT DOCUMENTS 2,398,223 A * 4/1946 Gilbert ..... 446/94
6,176,757 B1 * 1/2001 Lin ..... 446/115
2002/0065016 A1 * 5/2002 Huang ..... 446/103

FOREIGN PATENT DOCUMENTS

WO WO 9308885 A1 * 5/1993 ..... A63H/17/26

* cited by examiner

*Primary Examiner*—Ackun K. Jacob
*Assistant Examiner*—Bena Miller
(74) *Attorney, Agent, or Firm*—Charles E. Baxley

(57) ABSTRACT

A toy element set for constructional toy includes square planar elements, each square planar element having a center through hole, coupling elements adapted to connect square planar elements on a plane or at right angles, and gears, each gear having a split shaft pivotally connectable to the through hole of one planar element, the diameter of the pitch circle of the gears being equal to the length of the diagonal of the planar elements, each gear having a spacer flange at the inner side around the shaft and adapted to space the gear face of the respective gear from the corresponding planar element upon installation of the respective gear in the planar element.

7 Claims, 7 Drawing Sheets

TOY ELEMENT SET FOR CONSTRUCTIONAL TOY

BACKGROUND OF THE INVENTION

1. Field of the Invention

The present invention relates to toy element set for constructional toy and, more particularly to such a toy element set, which comprises a plurality of gears that can be pivotally detachably fastened to planar elements and meshed on a plane or at right angles.

2. Description of the Related Art

Various constructional toys have been disclosed and patented, and have appeared on the market. These constructional toys are not simply made for children to play with. They can also be used as educational implement. Harvey's U.S. Pat. No. 4,055,019 discloses a similar design, entitled "Constructional toy and element therefore". However, these conventional constructional toys are not successful in toy market because they are not attractive to children. People may purchase these conventional constructional toys simply for educational purpose.

According to Harvey's U.S. Pat. No. design, a planar element (polydron) is provided for use in building-up a model structure by hingedly and detachably connecting a plurality of such elements in edge-to-edge relationship. When using such planar elements to build up a model vehicle, as shown in FIG. 1, only particularly designed planar elements (the planar elements with a center axle hole) can be mounted with a wheel axle and a wheel. Further, the monotonous accessories of the constructional toy cannot attract children's attention.

SUMMARY OF THE INVENTION

The present invention has been accomplished under the circumstances in view. According to one aspect of the present invention, the toy element set for constructional toy comprises square planar elements, coupling elements, and gears. Each square planar element has a center through hole. The coupling elements are adapted to connect square planar elements on a plane or at right angles. Each gear has a split shaft pivotally connectable to the through hole of one planar element. The diameter of the pitch circle of the gears is equal to the length of the diagonal of the planar elements. Therefore, the gears can be fastened to a respective planar element and meshed on a plane or at right angles. Further, each gear has a spacer flange at the inner side around the shaft and adapted to space the gear face of the respective gear from the corresponding planar element upon installation of the respective gear in the planar element. According to another aspect of the present invention, each gear has a coupling structure at the outer side for the connection of a barrel-like toy element, and a plug hole at the center for the connection of a rod member or crank handle.

When a number of gears installed in a model structure formed of a number of planar elements and coupling elements, a crank handle can be fastened to one gear and turned by hand to rotate the meshed gear train and other toy accessories attached to the gears of the gear train. Because the diameter of the pitch circle of the gears is equal to the length of the diagonal of the planar elements, a part of the teeth of each gear protrudes over the peripheral sides of the corresponding planar element in which the respective gear is installed. Therefore, the gears can be used as vehicle wheels in a model vehicle built up with planar elements and coupling elements.

DETAILED DESCRIPTION OF THE PREFERRED EMBODIMENT

Figure 1:
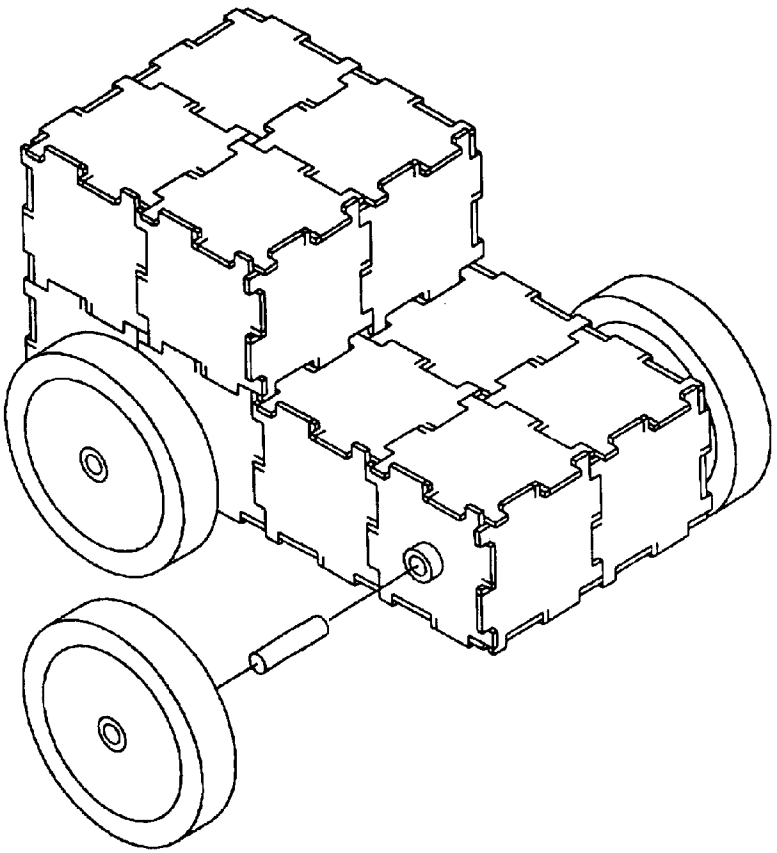
FIG. 1 PRIOR ART
FIG. 1 illustrates a model vehicle built up with. constructional toy elements according to the prior art.
Figure 2:
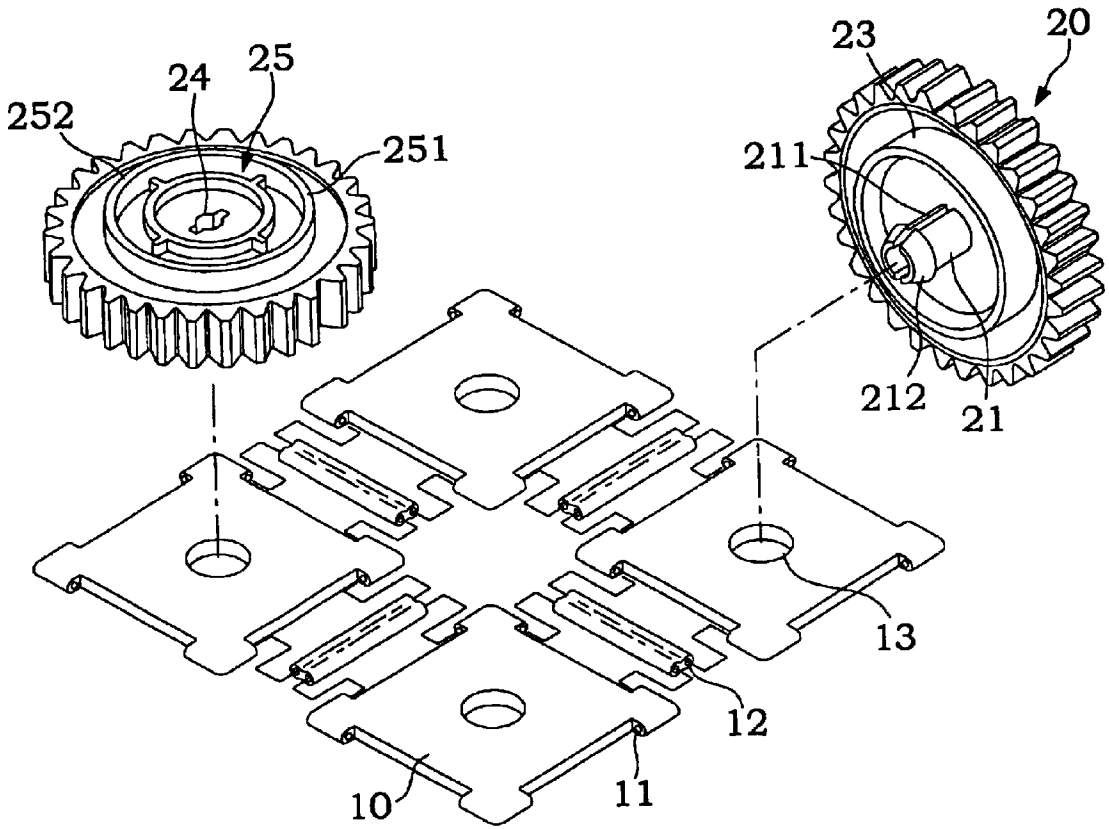
FIG. 2 is an exploded view of a part of a toy element set according to the present invention.

Referring to FIG. 2, the invention comprises a plurality of planar elements 10 of geometric shape, a plurality of coupling elements 12, and a plurality of gears 20.

The planar elements 10 are square plate members, each having at least one coupling portion 11 at each peripheral side for the connection of the coupling elements 12, and a through hole 13 at the center.

The coupling elements 12 are detachably connectable to the coupling portions 11 of the planar elements 10 to join the planar elements 10.

The gears 20 each comprise a shaft 21 perpendicularly extended from the center of one side, namely, the inner side, an annular spacer flange 23 located on the inner side around the shaft 21, a plug hole 24 at the center of the other side, namely, the outer side, and a coupling structure 25 located on the outer side. The shaft 21 has an expanded retaining head 212, and a longitudinal crevice 211 extended through the expanded retaining head 212. The coupling structure 25 comprises an annular outer locating flange 251 and an annular inner locating flange 252 concentrically located on the outer side around the plug hole 24. The diameter of the pitch circle 22 of the gears 20 is equal to the length of the diagonal of the planar elements 10 (see also FIG. 3). By means of the split shaft 21, each gear 20 can be detachably fastened to the through hole 13 of one planar element 10.

Figure 3:
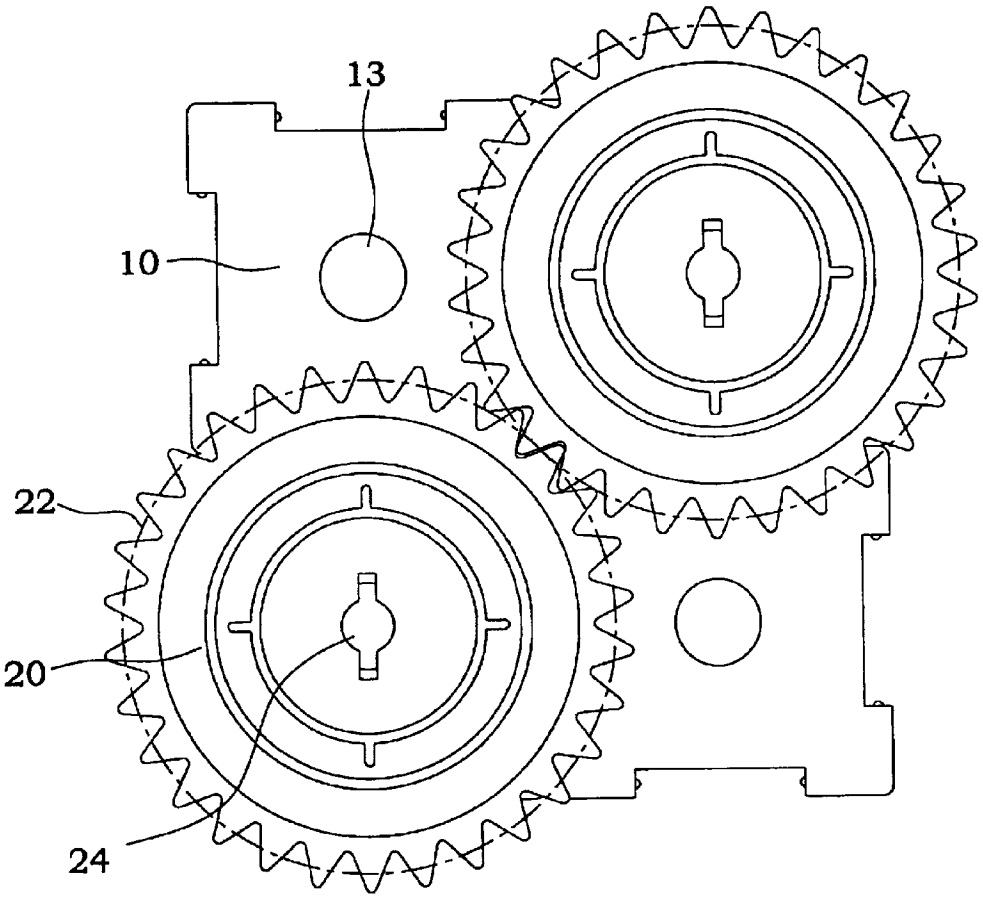
FIG. 3 is a schematic drawing showing two gears installed in a planar structure of planar elements and meshed according to the present invention.

Referring to FIG. 3, when a number of planar elements 10 built up a planar structure, two gears 20 can be respectively fastened to the through holes 13 of two diagonal planar elements 10 and maintained meshed. Because the diameter of the pitch circle 22 of the gears 20 is equal to the length of the diagonal of the planar elements 10, the pitch circles 22 of the two gears 20 at the two diagonal planar elements 10 are in tangent relationship. Therefore, the two gears 20 are maintained engaged with each other.

Figure 4:
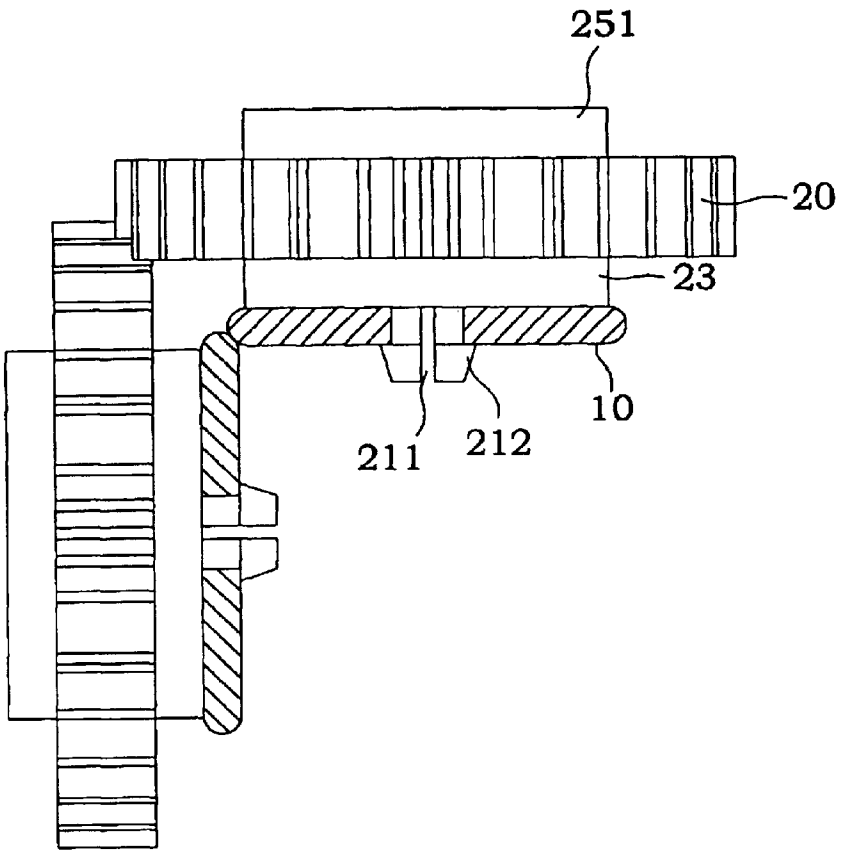
FIG. 4 is a schematic drawing showing two gears respectively mounted on two perpendicularly abutted planar elements and meshed according to the present invention.

Referring to FIG. 4, when a number of planar elements 10 built up a cubic structure, two gears 20 can be respectively fastened to two perpendicularly connected adjacent planar elements 10 and maintained meshed. Because the diameter of the pitch circle 22 of the gears 20 is equal to the length of the diagonal of the planar elements 10 and the annular spacer flange 23 has a certain height, the gear face of each gear 20 is spaced from the surface of the corresponding planar element 10 at a distance, and the two gears 20 at the two perpendicularly connected adjacent planar elements 10 are meshed together at right angles for smooth transmission without interference.

Figure 5:
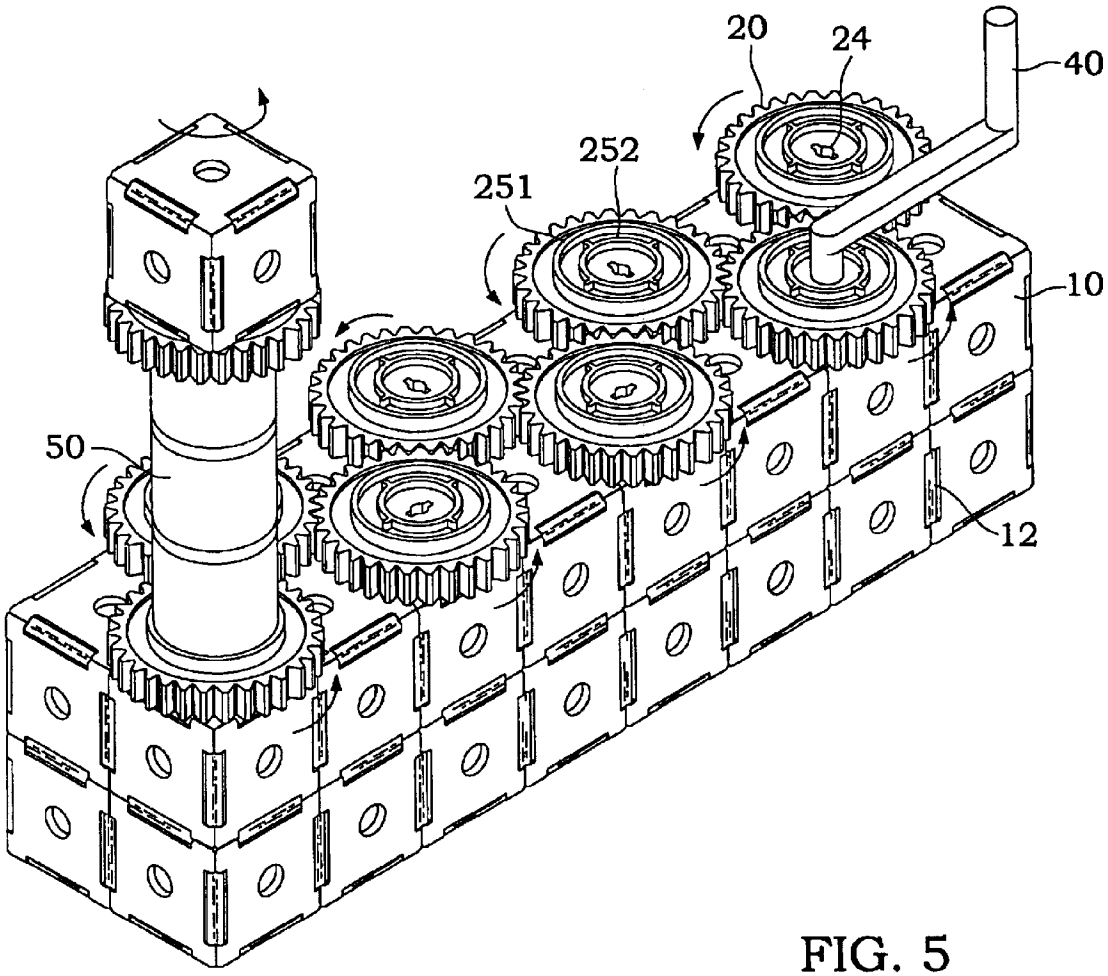
FIG. 5 is a schematic drawing showing an application example of the present invention.

Further, a crank handle 40 can be fastened to the plug hole 24 of one gear 20 for turning by hand to rotate meshed gears 20 (see FIG. 5). As indicated above, the coupling structure 25 of each gear 20 comprises an annular outer locating flange 251 and an annular inner locating flange 252 concentrically located on the outer side around the plug hole 24. A barrel-like element 50 can be perpendicularly inserted in between the annular outer locating flange 251 and an annular inner locating flange 252 and firmly secured to the coupling structure 25 by means of friction engagement (see FIG. 5).

As indicated above, crank handles 40, barrel-like elements 50 or rod-like elements can be fastened to the model structure built up with planar elements 10 and coupling elements 12. As shown in FIG. 5, a number of planar elements 10 and coupling elements 12 built up a rectangular model structure, a number of gears 20 are installed in the planar elements 10 at the top side of the rectangular model structure and meshed together, a crank handle 40 is fastened to one gear 20 for turning by hand to rotate the meshed gears 20, and a barrel-like element 50 is fastened to one gear 20 to support another structure formed of, for example, a gear 20 and a number of planer elements 10 and coupling elements 12. Same attachment may be symmetrically provided at two opposite sides of the rectangular model structure for enabling the two meshed gear trains at two sides of the rectangular model structure to be rotated in same direction (or reversed directions). Therefore, the invention greatly attracts young children to play. It can be used not only a toy but also an educational implement.

Figure 6:
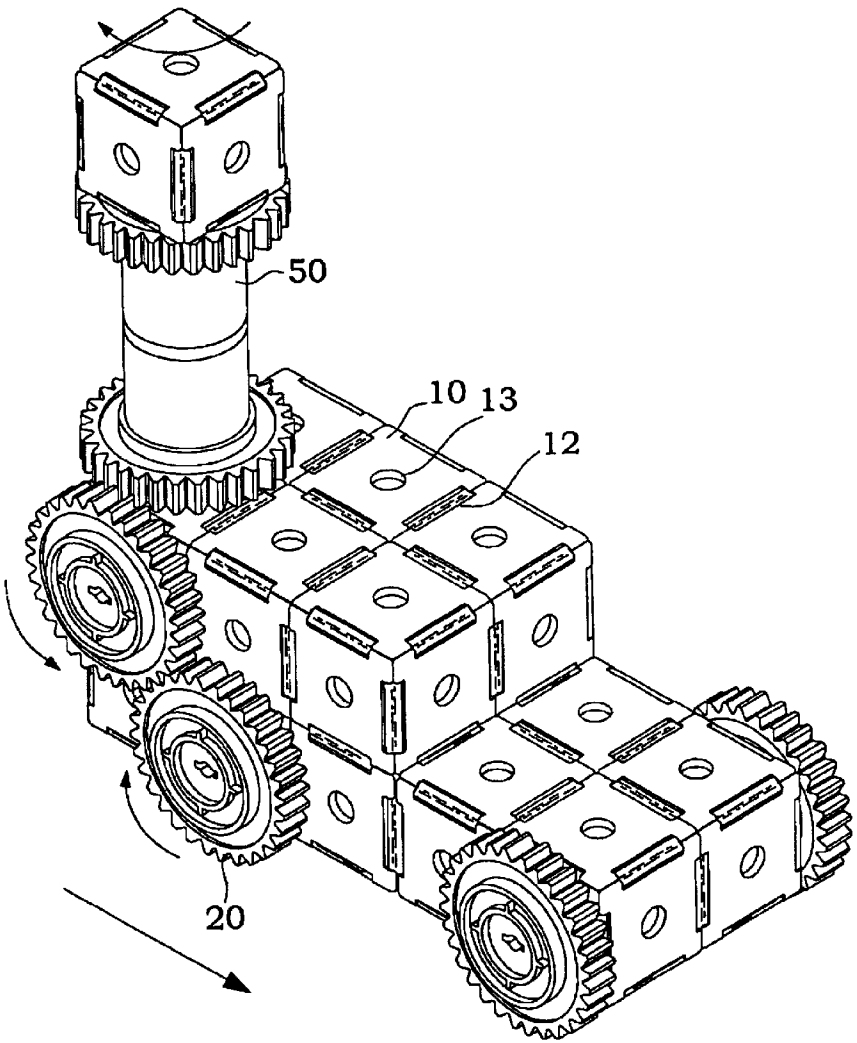
FIG. 6 is a schematic drawing showing another application example of the present invention.

FIG. 6 shows another application example of the present invention. According to this application example, a model vehicle is built up. Two pairs of gears 20 are symmetrically provided at two sides, working as the wheels. Additional gears 20 and other toy elements are installed in the model vehicle and meshed with one gear serving as a wheel, forming a movable decorative structure. When moving the model vehicle, the movable decorative structure is turned.

Figure 7:
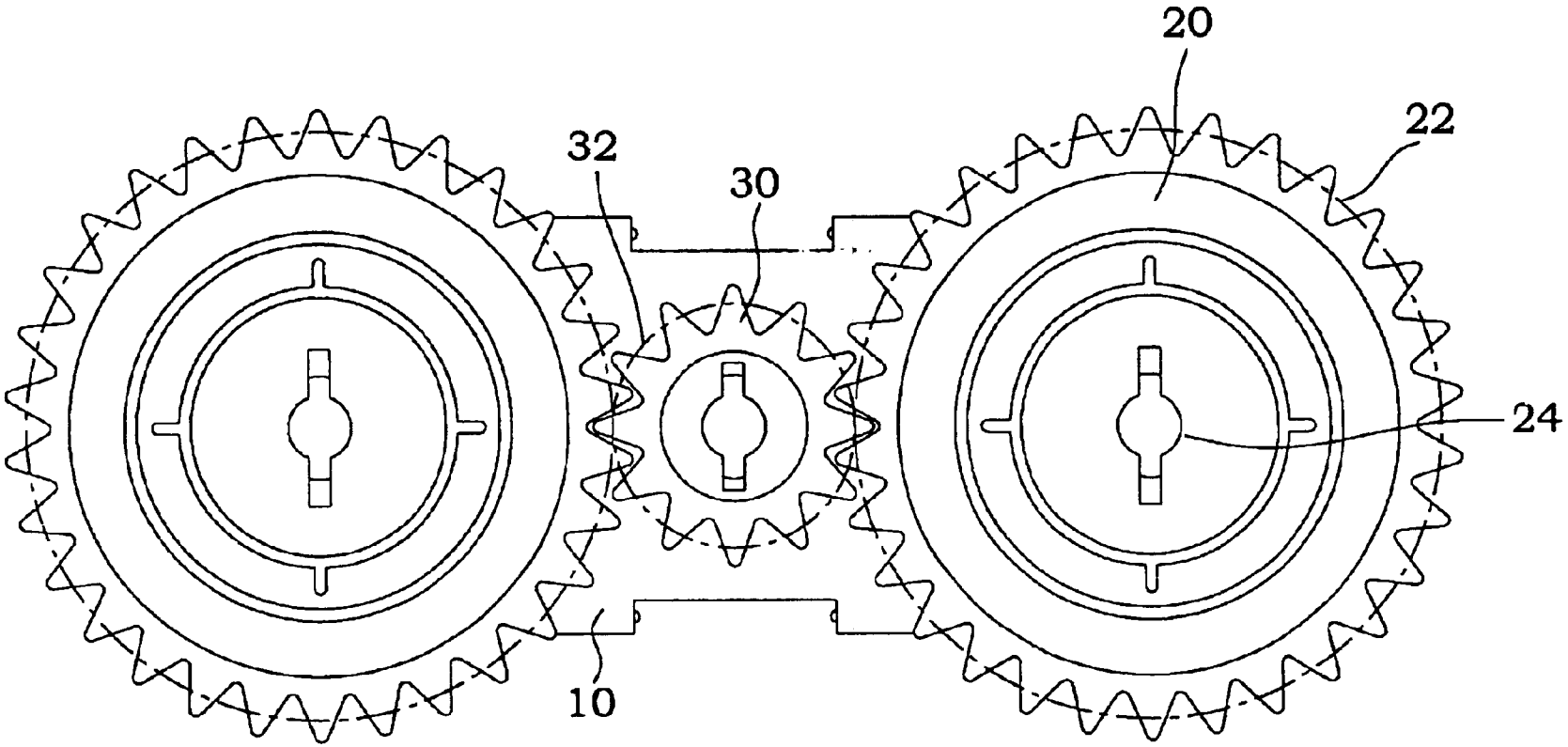
FIG. 7 illustrates a mini gear meshed between two gears at a planar structure of planar elements according to the present invention.

Referring to FIG. 7, the invention further comprises a mini gear 30. The mini gear 30 has a shaft (not shown) pivotally connectable to the through hole of one planar element 10. When three planar elements 10 are connected together on the same plane, the mini gear 30 is fastened to the middle planar element 10, and then two gears 20 are respectively fastened to the other two planar elements 10 and meshed with the mini gear 30 at two sides in a line. The pitch circles 22 of the gear 20 and the pitch circle 32 of the mini gear 30 are in tangent relationship, i.e., the diameter of the pitch circles 32 is $2-\sqrt{2}$ of the length of the sides of the planar elements 10, therefore the mini gear 30 can be smoothly meshed between the two gears 20.

A prototype of toy element set for constructional toy has been constructed with the features of FIGS. 2~7. The toy element set for constructional toy functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A toy element set for constructional toy comprising:

a plurality of planar elements having the shape of a square coupling portion at the peripheral sides thereof, and a through hole at the center thereof;

a plurality of coupling elements detachably connectable to the coupling portions of said planar elements to join said planar elements; and a plurality of gears detachably connectable to said planar elements, said gears each comprising a shaft perpendicularly extended from the center of an inner side thereof and pivotally connectable to the through hole of one said planar element;

wherein the diameter of the pitch circle of said gears is equal to the length of the diagonal of said planar elements; each said gear comprises a spacer flange located on the inner side around the respective shaft and adapted to space the gear face of the respective gear from the corresponding planar element upon installation of the respective gear in the planar element.

2. The toy element set as claimed in claim 1, wherein each said gear further comprises a coupling structure located on an outer side thereof for receiving a barrel-like toy element, said coupling structure comprising an annular outer locating flange and an annular inner locating flange located on the outer side.

3. The toy element set as claimed in claim 1, wherein each said gear has a plug hole at the center of the outer side.

4. The toy element set as claimed in claim 1, wherein each said plug hole is adapted to receive a crank handle.

5. The toy element set as claimed in claim 1, further comprising a mini gear detachably connectable to the through hole of one said planar element.

6. The toy element set as claimed in claim 5, wherein the diameter of the pitch circle of said mini gear is $2-\sqrt{2}$ of the length of the sides of said planar elements.

7. A toy element set for constructional toy comprising:

a plurality of planar elements having the shape of a square plate member, each said planar element comprising at least one coupling portion at the peripheral sides thereof, and a through hole at the center thereof;

a plurality of coupling elements detachably connectable to the coupling portions of said planar elements to join said planar elements; and a plurality of gears detachably connectable to said planar elements, said gears each comprising a shaft perpendicularly extended from the center of an inner side thereof and pivotally connectable to the through hole of one said planar element;

wherein the diameter of the pitch circle of said gears is equal to the length of the diagonal of said planar elements; each said gear comprises a spacer flange located on the inner side around the respective shaft and adapted to space the gear face of the respective gear from the corresponding planar element upon installation of the respective gear in the planar element wherein each of said gears further comprises a coupling structure located on an outer side thereof for receiving a barrel-like toy element, said coupling structure comprising an annular outer locating flange and an annular inner locating flange located on the outer side of said gears and wherein the annular outer locating flange and the annular inner locating flange are centrally located on the outer side of said gears.

* * * * *